US012798726B2

(12) United States Patent
Li et al.

(10) Patent No.: US 12,798,726 B2
(45) Date of Patent: Nov. 17, 2026

(54) CAVITATION LOAD-REDUCTION DEVICE FOR UNDERWATER VEHICLE HAVING ADJUSTABLE WATER ENTRY ANGLE

(71) Applicant: DALIAN UNIVERSITY OF TECHNOLOGY, Dalian (CN)

(72) Inventors: Yao Li, Dalian (CN); Tiezhi Sun, Dalian (CN); Zhi Zong, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 440 days.

(21) Appl. No.: 18/560,453

(22) PCT Filed: Oct. 27, 2022

(86) PCT No.: PCT/CN2022/127982
§ 371 (c)(1),
(2) Date: Nov. 13, 2023

(87) PCT Pub. No.: WO2023/072202
PCT Pub. Date: May 4, 2023

(65) Prior Publication Data

US 2024/0246637 A1 Jul. 25, 2024

(30) Foreign Application Priority Data

Oct. 29, 2021 (CN) ..... 202111275548.3

(51) Int. Cl.
*B63B 1/36* (2006.01)

(52) U.S. Cl.
CPC ..... *B63B 1/36* (2013.01)

(58) Field of Classification Search
CPC ..... B63B 1/38; B63B 1/36; B63B 2001/382; B63G 8/001; Y02T 70/10; B63C 11/52
See application file for complete search history.

(56) References Cited

U.S. PATENT DOCUMENTS 5,955,698 A * 9/1999 Harkins ..... F42B 10/46 102/390
6,405,653 B1 * 6/2002 Miskelly ..... F42B 15/20 89/1.807
6,684,801 B1 * 2/2004 Kuklinski ..... F42B 19/125 114/67 A

FOREIGN PATENT DOCUMENTS

CN 205707147 U 11/2016
CN 111806174 A 10/2020
CN 112413038 A 2/2021
CN 112413039 A 2/2021
CN 112413040 A 2/2021

(Continued)

*Primary Examiner* — Anthony D Wiest
(74) *Attorney, Agent, or Firm* — NKL Law; Allen Xue

(57) ABSTRACT

A cavitation load-reduction device for an underwater vehicle has adjustable water-entry angle. It contains a cavitator disposed at a head end of an underwater vehicle, a front end of the cavitator being detachably connected to a head fairing device that is coaxially arranged with the cavitator. The head fairing device comprises a head fairing, a plurality of notches are arranged in a rear end of a side wall of the head fairing around an axis of the head fairing, fairing tiles hinged to the notches are arranged at the notches, and the fairing tiles are matched with the notches. Each fairing tile retractable arm is separately hinged to the fairing tile and the cavitator, and the fairing tile retractable arms are used to drive the fairing tiles to rotate around a hinge point of the fairing tiles and the head fairing.

10 Claims, 11 Drawing Sheets

(56) References Cited

FOREIGN PATENT DOCUMENTS

| | | | |
|---|---|---|---|
| CN | 113879452 | A | 1/2022 |
| RU | 2107006 | C1 | 3/1998 |
| WO | 2016204347 | A1 | 12/2016 |

* cited by examiner

CAVITATION LOAD-REDUCTION DEVICE FOR UNDERWATER VEHICLE HAVING ADJUSTABLE WATER ENTRY ANGLE

TECHNICAL FIELD

The present invention relates to the technical field of vehicles, in particular to a cavitation load-reduction device for an underwater vehicle having an adjustable water-entry angle.

BACKGROUND

Modern underwater vehicles are increasingly launched using air vehicles, which places high requirements on the structural design of the underwater vehicles due to cross-medium flight at a high-speed. Firstly, in the air flight process, traditional vehicles are uncontrollable in water-entry posture, and it is often affected by complex factors such as the surrounding environment of the battlefield, and its water-entry angle is often unpredictable. Most high-speed water-entry buffering and load-reduction devices designed for the underwater vehicles often have a relatively obvious shock absorption and load-reduction effects only for conditions of vertical water-entry or large-angle water-entry. When the underwater vehicle enters water at a small angle or even almost flush with the water surface, the buffer head does not play a role in buffering and load-reduction. Therefore, it is of great significance to design a device that can regulate and control the airborne water-entry posture of the underwater vehicle in real time.

At the same time, the disc face area of the cavitator on the current vehicles is fixed, and the size of the supercavity generated is also constant, which cannot be adjusted according to the actual situation in the navigation process.

SUMMARY OF THE INVENTION

According to the above technical problems, the present invention provides a cavitation load-reduction device for an underwater vehicle having an adjustable water-entry angle.

Technical solutions adopted by the present invention are as follows:

The present invention provides a cavitation load-reduction device for an underwater vehicle having an adjustable water-entry angle, including a cavitator disposed at a head end of the underwater vehicle and coaxial with the underwater vehicle. A rear end center of the cavitator is connected to a head end center of the underwater vehicle by means of a connecting mechanism, and a side fairing device is disposed around the connecting mechanism. A rear end of the side fairing device is connected to an outer edge of the head end of the underwater vehicle, and a front end of the cavitator is detachably connected with a head fairing device coaxially disposed with the cavitator.

The head fairing device includes a head fairing, a rear end of a side wall of the head fairing is provided with a plurality of notches around an axis of the head fairing, a fairing tile is arranged at each the notch through hinge and is matched with each the notche.

A center of an inner surface of a front end of the head fairing is fixedly connected with a front end of a fairing support rod, and a rear end of the fairing support rod is detachably connected with a center of the cavitator. Each the fairing tile is connected with a middle part of the cavitator by means of a fairing tile retractable arm which is hinged with the fairing tile and the cavitator. The fairing tile retractable arm is used to drive the fairing tile to rotate around a hinge point of the fairing tile and the head fairing.

The cavitator includes a cavitator body and a plurality of cavitator disc face retractable sheets, and the plurality of cavitator disc face retractable sheets are evenly distributed around an axis of the cavitator body. The side fairing device includes a linkage adjusting device for driving the cavitator disc face retractable sheets to contract and extend in a radial direction of the cavitator body.

When the plurality of cavitator disc face retractable sheets extend out, there is a clearance between each two adjacent cavitator disc face retractable sheets, and the clearance is matched with the fairing tile. The plurality of fairing tiles are detachably hinged with the notches. After being separated from the head fairing, the plurality of fairing tiles move to and fill the clearances, so that a surface of the cavitator forms a complete circular surface.

After being separated from the head fairing, the plurality of fairing tiles are subjected to impact force of air or water, so that the posture of the fairing tiles can be automatically adjusted until the fairing tiles enter and fill the clearances.

Preferably, both ends of each the fairing tile retractable arm are respectively hinged with the corresponding fairing tile and the middle part of the cavitator body by means of two active rotating mechanisms. One of the active rotating mechanisms is used to drive the fairing tile retractable arm to actively rotate around the hinge point of the fairing tile retractable arm and the cavitator body, and another active rotating mechanism is used to drive the fairing tile to actively rotate around the hinge point of the fairing tile and the fairing tile retractable arm. An object of this design is to adjust the postures of the fairing tile retractable arm and the fairing tile, so as to make the fairing tiles smoothly enter the clearances, so that a surface of the cavitator forms a complete circular surface.

The side fairing device further includes a side fairing fixed on the outer edge of the head end of the underwater vehicle. The linkage adjusting device includes a plurality of airfoil adjusting sheets, a number of the airfoil adjusting sheets is matched with a number of the cavitator disc face retractable sheets, and the airfoil adjusting sheets are uniformly distributed around the axis of the cavitator body. Each the airfoil adjusting sheet corresponds to one cavitator disc face retractable sheet. A rear end of each the airfoil adjusting sheet is hinged with an outer edge of a front end of the side fairing. A side of each the airfoil adjusting sheet close to its rear end is hinged with one end of a first buffer retractable arm and a side of that close to its front end is hinged with one end of a second buffer retractable arm, the other end of the first buffer retractable arm is hinged with a front end face of the head end of the underwater vehicle, and the other end of the second buffer retractable arm is hinged with an upper part of the cavitator disc face retractable sheet. A cross section of the airfoil adjusting sheet is airfoil shape, and two adjacent airfoil adjusting sheets are closely attached.

The underwater vehicle is inside provided with a gas storage device.

A front center of the cavitator is provided with a first jet port, and the gas storage device is communicated with the first jet port by means of a first vent pipeline system.

An outer wall of the head fairing is provided with a plurality of second jet ports, and the plurality of second jet ports are communicated with the gas storage device by means of a second vent pipeline system.

A circumferential outer wall of the head end of the underwater vehicle is provided with a plurality of jet units, and an axis direction of each the jet unit is perpendicular to the circumferential outer wall of the head end of the underwater vehicle. A side wall of each the jet unit is provided with a plurality of third jet ports arranged around the axis of the jet unit. One end, away from the circumferential outer wall of the head of the underwater vehicle, of each the jet unit is also provided with a third jet port, the plurality of third jet ports are communicated with the gas storage device by means of the third vent pipeline system, and the plurality of third jet ports are not communicated with each other. The third vent pipeline system includes the third jet port, a third vent pipe and a second vent valve.

The connecting mechanism is a damper, including a first outer sleeve. The first outer sleeve is provided with a first piston rod inside, a front end of the first piston rod penetrates out of the first outer sleeve and is fixedly connected with the cavitator body, and a rear end of the first piston rod is provided with a first piston. A part between the first piston and the front end of the first outer sleeve is provided with a tension spring sleeved on the first piston rod, the rear end of the first outer sleeve is fixedly connected with the head end of the underwater vehicle, and a part between the rear end of the first outer sleeve and the first piston forms a first hydraulic oil chamber which is communicated with an oil storage chamber arranged in the first outer sleeve.

The first vent pipeline system includes a first vent pipe, and a rear end of the first vent pipe is communicated with a gas storage device. The first vent pipe is provided with a first vent valve inside, a front end of the first vent pipe successively passes through a center of a rear end of the first outer sleeve and a center of the first piston, penetrates into the first piston rod, and is in airtight sliding connection with inner walls of the first piston rod and the first piston. An inside of a third piston rod near its front end is provided with a buffer gas chamber, and a rear end of the buffer gas chamber is communicated with the front end of the first vent pipe. The buffer gas chamber is provided inside with a first pressure spring with an axis coinciding with an axis of the first piston rod, an end face of the first vent pipe abuts against the first pressure spring, the front end of the first piston rod is provided with a through hole communicated with the buffer gas chamber, and a front end of the through hole is communicated with the first jet port.

The second vent pipeline system includes a second vent pipe disposed in the fairing support rod. A rear end of the second vent pipe is communicated with the first jet port, and a rear end of the second jet port is communicated with the second jet port through a hose.

The third pipeline system further includes a high-pressure gas collecting chamber which is communicated with the gas storage device by means of a pipeline. The high-pressure gas collecting chamber is communicated with a central gas passage of the jet unit by means of the third vent pipe, and the third jet port is communicated with the central gas passage by means of the second vent valve and a branch gas passage.

Compared with the prior art, the present invention has the following beneficial effects:

The present invention takes into account the advantages of adjusting the posture of the underwater vehicle during air fight, controlling the water-entry angle of the underwater vehicle, adjusting the size of supercavity generated by the cavitator, and high-speed water-entry and load-reduction of the underwater vehicle. The present invention is suitable for air launch and high-speed water-entry work conditions of air-launched rotary vehicles, especially for vehicles with high initial velocity launch. The present invention utilizes streamlined and detachable fairing device and its attachments to enhance aerodynamic performance, utilizes the combination of the third jet port and the fairing tile to adjust the flying posture and water-entry angle of the underwater vehicle, utilizes the first jet port and the second jet port to achieve deceleration and load-reduction of the underwater vehicle, and utilizes the damper disposed behind the cavitator to achieve head load-reduction of the underwater vehicle, and dampers with different damping can be replaced as needed to achieve different degrees of load-reduction. The present invention utilizes the airfoil adjusting sheets, the first buffer retractable arms, the second buffer retractable arms and the cavitator disc face retractable sheets to adjust the cavitator in real time, so as to obtain a more suitable supercavity for the current working condition. After being separated from the head fairing, the faring tiles fill the clearances between adjacent cavitator disc face retractable sheets, making the cavitator to form a complete circular surface as a whole.

Based the above reasons, the present invention can be widely popularized in fields such as vehicles.

DETAILED DESCRIPTION OF DRAWINGS

In order to more clearly illustrate the technical solution in the embodiment of the present invention or the prior art, the following is a brief introduction of the accompanying drawings required to be used in the description of the embodiment or the prior art. Obviously, the accompanying drawings in the description below are some embodiments of the present invention. For those ordinary in the art, other accompanying drawings can also be obtained from these accompanying drawings without creative labor.

Figure 1:
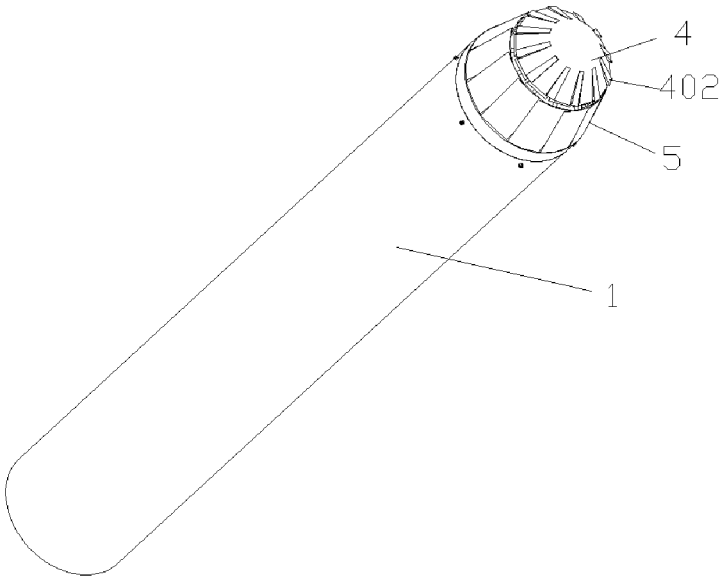
FIG. 1 shows a three-dimensional view of a cavitation load-reduction device for an underwater vehicle having an adjustable water-entry angle in an embodiment of the present invention (the fairing tiles are not unfolded).

In the figures: 1. underwater vehicle; 2. cavitator; 201. cavitator body; 202. cavitator disc face retractable sheet; 203. groove; 204. sliding U-shaped limiting slot; 205. sliding limiting protrusion; 3. connecting mechanism; 301. damper base; 302. first outer sleeve; 303. first piston rod; 304. first piston; 305. tension spring; 306. first hydraulic oil chamber; 4. head fairing device; 401. head fairing; 402. fairing tile; 403. fairing support rod; 404. fairing tile retractable arm; 405. lug slot; 406. hinge lug; 407. active motor; 408. spline; 5. side fairing device; 501. side fairing; 502. airfoil adjusting sheet; 503. first buffer retractable arm; 504. second buffer retractable arm; 505. second outer sleeve; 506. second piston rod; 507. second piston; 508. second hydraulic oil chamber; 509. second pressure spring; 6. gas storage device; 601. first jet port; 602. first vent pipe; 603. first vent valve; 604. first pressure spring; 605. through hole; 606. second jet port; 607. second vent pipe; 608. hose; 7. high-pressure gas collecting chamber; 8. jet unit; 801. third jet port; 802. third vent pipe; 803. second vent valve.

DETAILED DESCRIPTION OF PREFERRED EMBODIMENTS

It should be noted that, in the case of no conflicts, the embodiments and the features in the embodiments of the present invention can be combined mutually. The present invention will be described in detail below with reference to the accompanying drawings and the embodiments.

To make the objectives, technical solutions, and advantages of the present invention clearer, the following clearly and completely describes the technical solutions in the embodiments of the present invention with reference to the accompanying drawings in the embodiments of the present invention. Apparently, the described embodiments are merely some rather than all of the embodiments. The following description of at least one exemplary embodiment is actually only illustrative, and in no way serves as any limitation on the present invention and its application or use. Based on the embodiments of the present invention, all the other embodiments obtained by those of ordinary skill in the art without inventive effort are within the protection scope of the present invention.

It should be noted that the terms used herein are only intended to describe specific embodiments and are not intended to limit the exemplary embodiments of the present invention. As used herein, unless indicated obviously in the context, a singular form is intended to include a plural form. Furthermore, it should be further understood that the terms "include" and/or "comprise" used in this specification specify the presence of features, steps, operations, devices, components and/or of combinations thereof.

Unless specifically stated otherwise, the relative arrangement of components and steps, numerical expressions, and numerical values set forth in these embodiments do not limit the scope of the present invention. In addition, it should be clear that, for ease of description, sizes of the various components shown in the accompanying drawings are not drawn according to actual proportional relationships. Technologies, methods, and devices known to those of ordinary skill in the relevant fields may not be discussed in detail, but where appropriate, the technologies, methods, and devices should be considered as a part of the authorization specification. In all the examples shown and discussed herein, any specific value should be interpreted as merely being exemplary rather than limiting. Therefore, other examples of the exemplary embodiment may have different values. It should be noted that similar reference signs and letters represent similar items in the accompanying drawings below. Therefore, once an item is defined in one accompanying drawing, the item does not need to be further discussed in a subsequent accompanying drawing.

In the description of the present invention, it should be noted that orientations or position relationships indicated by orientation terms "front, rear, upper, lower, left, and right", "transverse, vertical, perpendicular, and horizontal", "top and bottom", and the like are usually based on orientations or position relationships shown in the accompanying drawings, and these terms are only used to facilitate description of the present invention and simplification of the description. In the absence of description to the contrary, these orientation terms do not indicate or imply that the apparatus or element referred to must have a specific orientation or be constructed and operated in a specific orientation, and therefore cannot be understood as a limitation on the protection scope of the present invention: orientation words "inner and outer" refer to the inside and outside relative to the contour of each component.

For ease of description, spatially relative terms such as "on", "over", "on the upper surface", and "above" can be used here to describe a spatial positional relationship between one device or feature and another device or feature shown in the figures. It should be understood that the spatially relative terms are intended to include different orientations in use or operation other than the orientation of the device described in the figure. For example, if the device in the figure is inverted, the device described as "above another device or structure" or "on another device or structure" is then be positioned as being "below another device or structure" or "beneath a device or structure". Therefore, the exemplary term "above" can include both orientations "above" and "below". The device can also be positioned in other different ways (rotating by 90 degrees or in another orientation), and the spatially relative description used herein is explained accordingly.

In addition, it should be noted that using terms such as "first" and "second" to define components is only for the convenience of distinguishing the corresponding components. Unless otherwise stated, the foregoing words have no special meaning and therefore cannot be understood as a limitation on the protection scope of the present invention.

As shown in FIGS. 1-23, a cavitation load-reduction device for an underwater vehicle having an adjustable water-entry angle includes a cavitator 2 disposed at a head end of the underwater vehicle 1 and coaxial with the underwater vehicle 1. A rear end center of the cavitator 2 is connected to the head end center of the underwater vehicle 1 by means of a connecting mechanism 3, and a side fairing device 5 is disposed around the connecting mechanism 3. A rear end of the side fairing device 5 is connected to the outer edge of the head end of the underwater vehicle 1, and the front end of the cavitator 2 can be detachably connected with a head fairing device 4 that is coaxially disposed with the cavitator 2.

Figure 9:
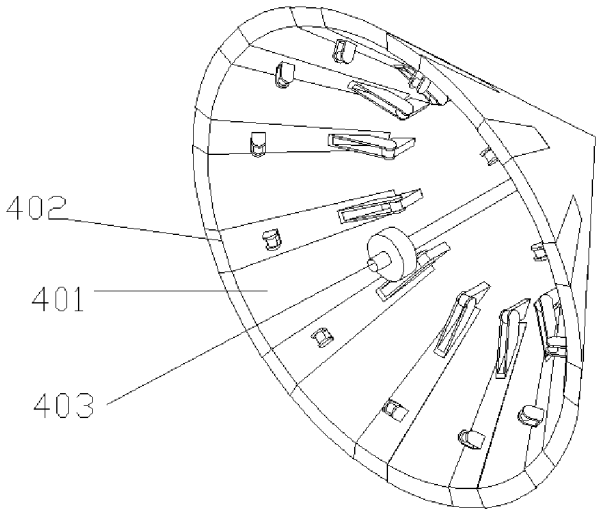
FIG. 9 shows a schematic structural diagram of a head fairing device in an embodiment of the present invention (the fairing tile retractable arms are removed and the fairing tiles are not unfolded).
Figure 10:
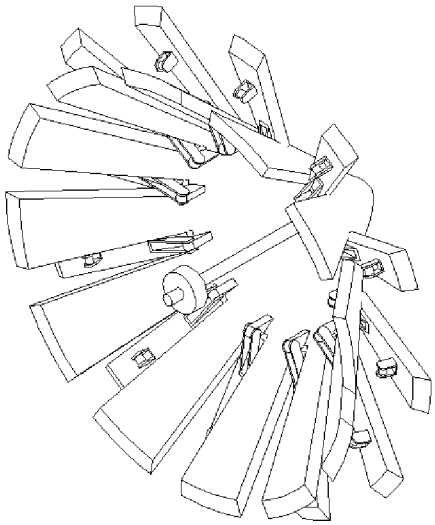
FIG. 10 shows a schematic structural diagram of a head fairing device in an embodiment of the present invention (the fairing tile retractable arms are removed and the fairing tiles are unfolded).

As shown in FIGS. 9 and 10, the head fairing device 4 includes a head fairing 401. A rear end of a side wall of the head fairing 401 is provided with a plurality of notches around an axis of the head fairing 401, a fairing tile 402 is arranged at each the notch through detachable hinge and is matched with the notch.

An inner surface center of a front end of the head fairing 401 is fixedly connected with a front end of a fairing support rod 403, and a rear end of the fairing support rod 403 is detachably connected with a center of the cavitator 2 (detachable connection may be achieved by means of electromagnet adsorption). Each the fairing tile 402 is connected with a middle part of the cavitator 2 by means of a fairing tile retractable arm 404 which is hinged with the fairing tile 402 and the cavitator 2. The fairing tile retractable arm 404 is used to drive the fairing tile 402 to rotate around a hinge point of the fairing tile 402 and the head fairing 401. The extension of the fairing tile retractable arm 404 may achieve that the tail end of the fairing tile 402 rotates around the front end of that, thereby achieving the shape of the head fairing device 4, and at this time, the contact area between the head fairing device 4 and the air is increased, so that the load is reduced.

The whole head fairing device 4 is streamlined in a conical shape, which can be considered as a whole after filling the notch with the fairing tile 402 and will not be subjected to additional resistance in the air flight process. The head fairing 401 can be provided with a pop-up airbag, so that it can be conveniently recycled after being separated from the underwater vehicle 1.

Figure 11:
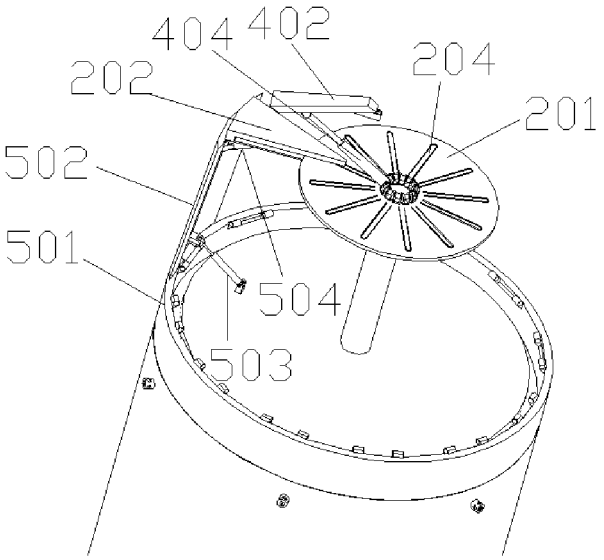
FIG. 11 shows a schematic structural diagram of a side fairing and a cavitator in an embodiment of the present invention (only shows one airfoil adjusting sheet and one cavitator disc face retractable sheet).
Figure 12:
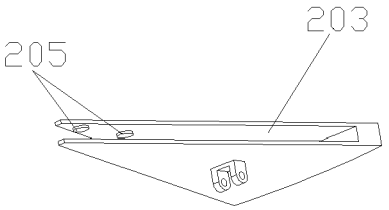
FIG. 12 shows a schematic structural diagram of a cavitator disc face retractable sheet in an embodiment of the present invention.

As shown in FIGS. 11 and 12, the cavitator 2 includes a cavitator body 201 and a plurality of cavitator disc face retractable sheets 202. The plurality of cavitator disc face retractable sheets 202 are evenly distributed around the axis of the cavitator body 201. The side fairing device 5 includes a linkage adjusting device for driving the cavitator disc face retractable sheets 202 to contract and extend in a radial direction of the cavitator body 201.

Each the cavitator disc face retractable sheet 202 is fan-shaped or triangular and is inside provided with a groove 203 accommodating the cavitator body. Sliding U-shaped limiting slots 204 extending in a radial direction are machined on the cavitator body 201, and sliding limiting protrusions 205 (two in this embodiment) matched with the sliding U-shaped limiting slots 204 are machined on the cavitator disc face retractable sheet 202.

Figure 8:
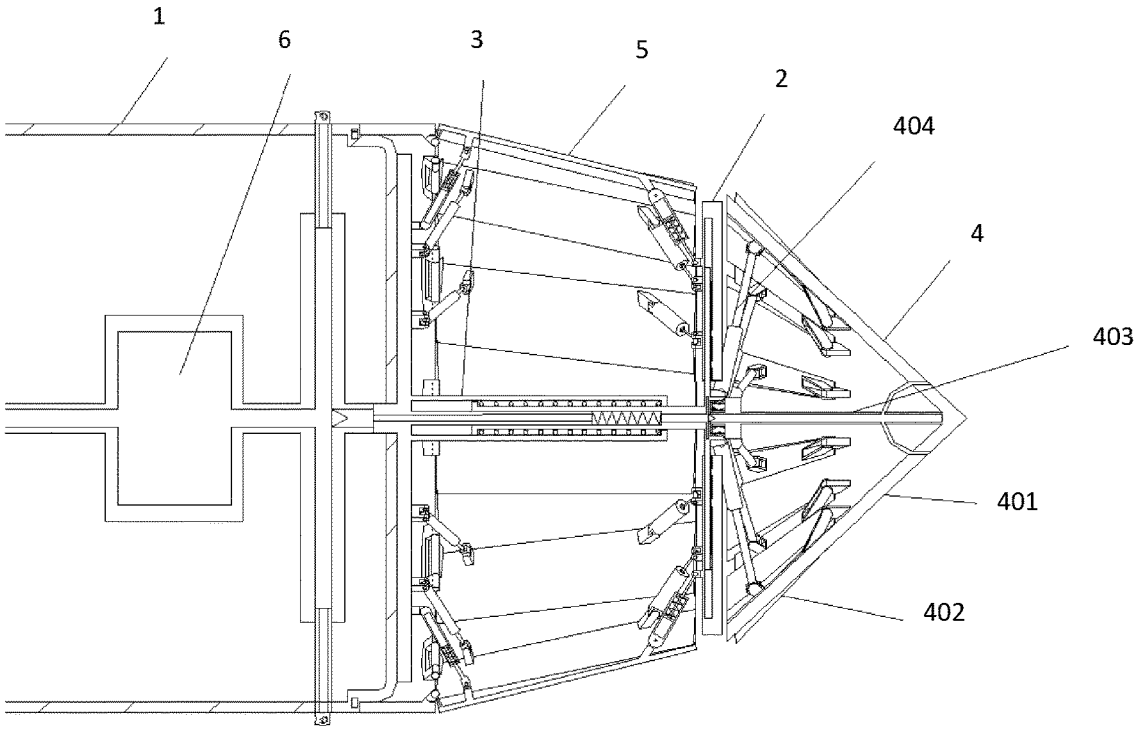
FIG. 8 shows an A-A sectional view in the FIG. 7.

As shown in FIGS. 8 and 11, the side fairing device 5 further includes a side fairing 501 fixed on the outer edge of the head end of the underwater vehicle 1. The linkage adjusting device includes a plurality of airfoil adjusting sheets 502. A number of the airfoil adjusting sheets 502 is matched with a number of the cavitator disc face retractable sheets 202, and the airfoil adjusting sheets 502 are uniformly distributed around the axis of the cavitator body 201. Each the airfoil adjusting sheet 502 corresponds to one cavitator disc face retractable sheet 202. A rear end of the airfoil adjusting sheet 502 is hinged with an outer edge of a front end of the side fairing 501. A side of each the airfoil adjusting sheet 502 close to its rear end is hinged with one end of a first buffer retractable arm 503 and a side of that close to its front end is hinged with one end of a second buffer retractable arm 504, and the other end of the first buffer retractable arm 503 is hinged with a front end face of the head end of the underwater vehicle 1 (in an embodiment, the other end of the first buffer retractable arm 503 is hinged with the damper base 301 which is fixed on the head end face of the underwater vehicle 1). The other end of the second buffer retractable arm 504 is hinged with an upper part of the cavitator disc face retractable sheet 202. The cross section of the airfoil adjusting sheet 502 is airfoil shape. Two-thirds of the profile of each the airfoil adjusting sheet 502 is a thinner streamlined shape, and the other one-third of the profile is a thick airfoil profile. An object of this design is to ensure that the adjacent airfoil adjusting sheets 502 can be closely attached with each other to minimize the clearance, so that the entire appearance of the underwater vehicle 1 mounted the head fairing device 4 can achieve the best streamline. When the airfoil adjusting sheet 502 contracts radially inward, the thicker end can smoothly slide to the inner side of the thinner end of the adjacent airfoil adjusting sheet 502, ensuring a good overall appearance without being abrupt. Through the operation of the first buffer retractable arms 503 and the second buffer retractable arms 504, the cavitator disc face retractable sheets 202 can be unfolded, and the head end of the airfoil adjusting sheets 502 are also unfolded, so that the plurality of airfoil adjusting sheets 502 are gradually changed into a cylinder shape from a truncated cone shape. The unfolding of the cavitator disc face retractable sheets 202 realizes the increase of the disc face of the cavitator 2.

Figure 5:
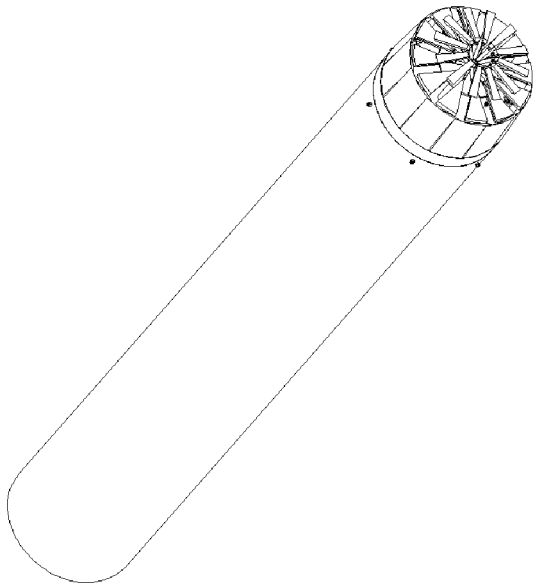
FIG. 5 shows a three-dimensional view of a cavitation load-reduction device after the head fairing is separated in an embodiment of the present invention (the cavitator disc face retractable sheets are not completely unfolded and the fairing tiles are not completely reset).

As shown in FIG. 5, when the plurality of cavitator disc face retractable sheets 202 extend out, there is a clearance between each two adjacent cavitator disc face retractable sheets 202, and the clearance makes the surface of the cavitator 2 not be a complete circular surface. Therefore, in an embodiment, the surface of the cavitator 2 is enabled to be complete by filling the clearance after the fairing tile 402 moves. The solution is as follows.

Figure 6:
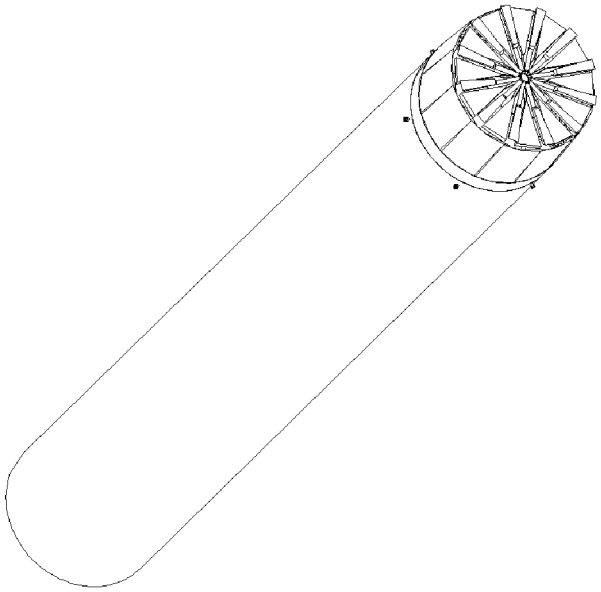
FIG. 6 shows a three-dimensional view of a cavitation load-reduction device after the head fairing is separated in an embodiment of the present invention (the cavitator face retractable sheet are completely unfolded and the fairing tiles are completely reset).
Figure 7:
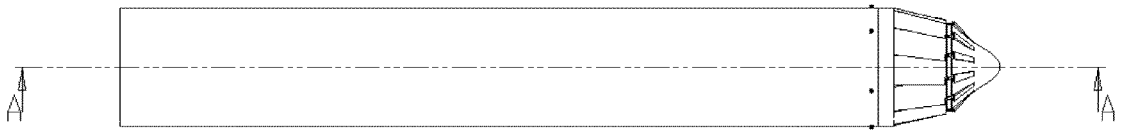
FIG. 7 shows a side view of a cavitation load-reduction device for an underwater vehicle having an adjustable water-entry angle in an embodiment of the present invention.

As shown in FIG. 6, the shape of the fairing tile 402 is matched with the clearance, and the fairing tile 402 is detachably hinged with the notch. After being separated from the head fairing 401, the fairing tile 402 moves to and fills the clearance, so that a surface of the cavitator forms a complete circular surface. The cavitator body 201 may be provided with a plurality of accommodating grooves for accommodating structures such as the fairing tile retractable arm 404 to make the surface of the cavitator 2 smoother.

Figure 13:
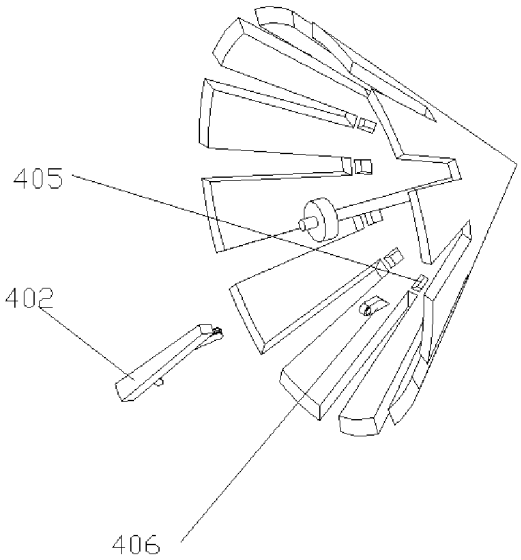
FIG. 13 shows a decomposition schematic diagram of detachable hinge between a fairing tile and a head fairing in an embodiment of the present invention.

A detachable hinge solution is as follows: as shown in FIG. 13, the inner wall of the head fairing 401 is provided with a lug slot 405, and a hinge lug 406 is adsorbed in the lug slot 405 by means of an electromagnet. The hinge lug 406 is in a block shape, with a hinge hole in the middle thereof. One end, close to the head fairing 401, of the fairing tile 402 is provided with a hinge shaft matched with the hinge hole. The hinge shaft is disposed in the hinge hole to achieve hinge joint, and the extension direction of the hinge shaft is parallel to the width direction of the fairing tile 402. The lug slot 405 and the hinge lug 406 achieve detachable connection between the fairing tile 402 and the head fairing 401 through electromagnetic adsorption.

Generally, the underwater vehicle 1 enters water from its front side. At this time, the fairing tile 402 and the fairing tile retractable arm 404 separated from the head fairing 401 will automatically deform when being subjected to air and water resistance (that is, the fairing tile 402 passively rotates around the hinge point of the fairing tile 402 and the fairing tile retractable arm 404, and the fairing tile retractable arm 404 passively rotates around the hinge point of the fairing tile retractable arm 404 and the cavitator body 201), thereby automatically filling the clearance.

Figure 14:
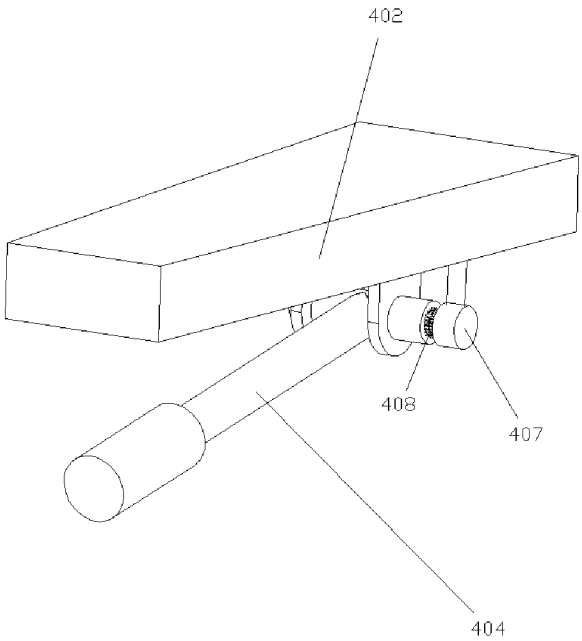
FIG. 14 shows a schematic structural diagram of an active rotating mechanism in an embodiment of the present invention.

It is also possible to actively drive the fairing tile retractable arm 404 and the fairing tile 402 to rotate to fill the clearance, as shown in FIG. 14. The solution is as follows:

Both ends of the fairing tile retractable arm 404 are respectively hinged with the fairing tile 402 and the middle part of the cavitator body 201 by means of two active rotating mechanisms. One active rotating mechanism is used to drive the fairing tile retractable arm 404 to actively rotate around the hinge point of the fairing tile retractable arm 404 and the cavitator body 201, and another active rotating mechanism is used to drive the fairing tile 402 to actively rotate around the hinge point of the fairing tile 402 and the fairing tile retractable arm 404. An object of this design is to adjust the postures of the fairing tile retractable arm 404 and the fairing tile 402, so as to make the fairing tiles smoothly enter the clearances, so that a surface of the cavitator 2 forms a complete circular surface. The active rotating mechanism may drive the hinge shaft of the fairing tile 402 and the fairing tile retractable arm 404 in a manner such as a motor gear, thereby driving the fairing tile 402 and the fairing tile retractable arm 404 to actively rotate. In an embodiment, the two active rotating mechanisms have the same structure, including an active motor 407. An output shaft of the active motor 407 is connected to the hinge shaft through a spline 408. The connection mode of the active rotating mechanism located at the fairing tile 402 and the fairing tile retractable arm 404 is that a lug plate is mounted on the fairing tile 402, a hinge shaft is fixed on the fairing tile retractable arm 404, and the active motor 407 is fixedly connected to the fairing tile through a bracket (as shown in FIG. 14). The connection mode of the active rotating mechanism located at the fairing tile retractable arm 404 and the cavitator body 201 is that a lug plate is fixed on the cavitator body 201, a hinge shaft is fixed on the fairing tile retractable arm 404, the hinge shaft is connected to the active motor 407 through a spline 408, and the active motor 407 is fixed on the cavitator body 201 (figure omitted). The active rotating mechanisms are waterproof and sealed.

Figure 15:
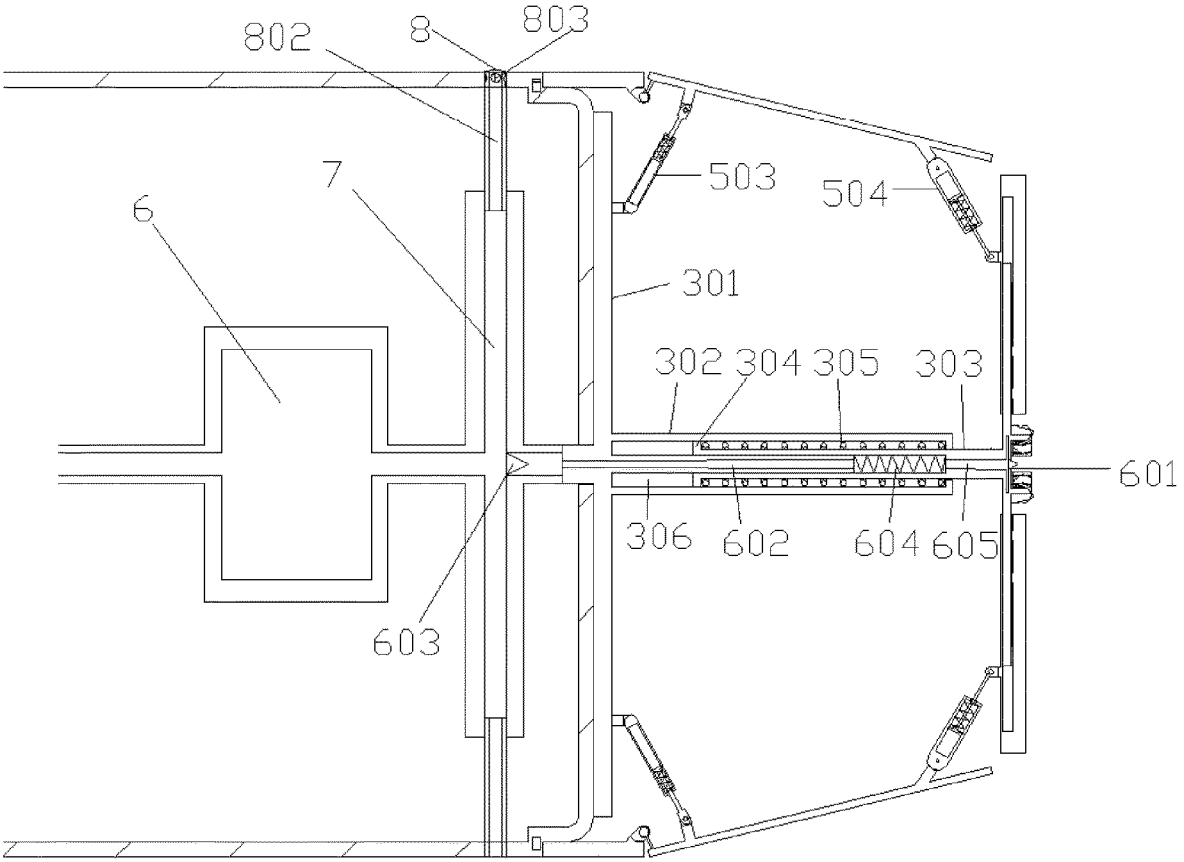
FIG. 15 shows a partial schematic diagram of a space enclosed by a side fairing device in an embodiment of the present invention.

As shown in FIG. 15, in an embodiment, the connecting mechanism 3 is a damper, including a first outer sleeve 302. The first outer sleeve 302 is provided with an oil storage chamber and a first piston rod 303 inside. The front end of the first piston rod 303 penetrates out of the first outer sleeve 302 and is fixedly connected to the cavitator body 201, and the rear end of the first piston rod 303 is provided with a first piston 304. A part between the first piston 304 and the front end of the first outer sleeve 302 is provided with a tension spring 305 sleeved on the first piston rod 303. The damper base 301 is fixedly connected to a head end surface of the underwater vehicle 1. The rear end of the first outer sleeve 302 is fixedly connected to the head end of the damper base 301. A part between the rear end of the first outer sleeve 302 and the first piston 304 forms a first hydraulic oil chamber 306 which is communicated with the oil storage chamber. The damper can provide mechanical load-reduction to the underwater vehicle 1 when it entering water, so as to protect the underwater vehicle 1. At the same time, the first buffer retractable arm 503 and the second buffer retractable arm 504 are oblique when the underwater vehicle 1 entering water, which results a horizontal component force and a vertical component force. The horizontal component force can provide load-reduction, while the vertical component force can better maintain the extended state of the cavitator disc face retractable sheet 202 and maintain the stability of the cavitator.

Figure 16:
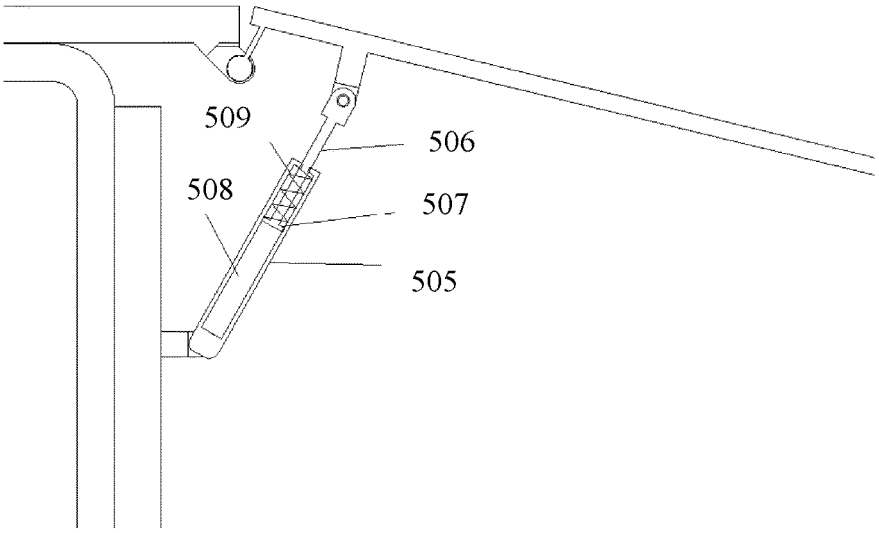
FIG. 16 shows a schematic structural diagram of a first buffer retractable arm in an embodiment of the present disclosure.
Figure 17:
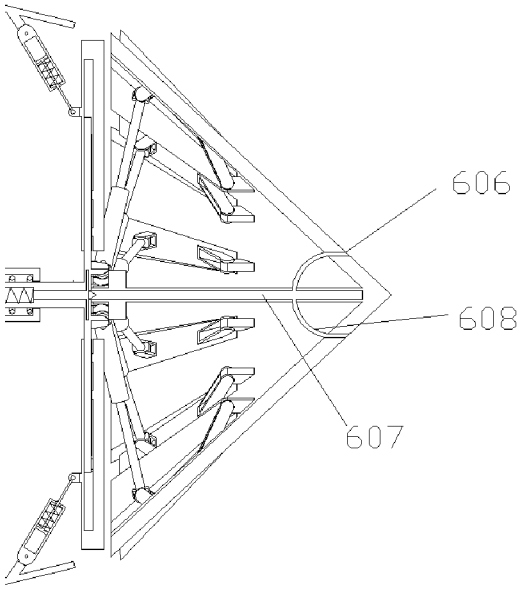
FIG. 17 shows a cross-sectional view of an inside of a head fairing device in an embodiment of the present invention.
Figure 18:
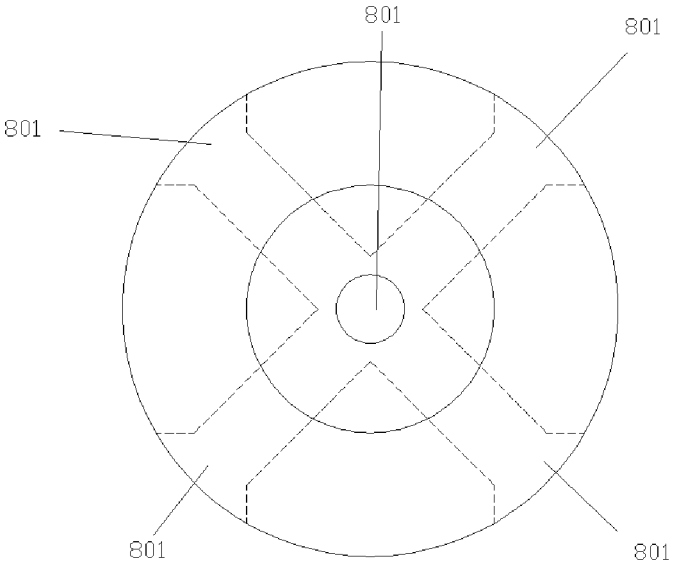
FIG. 18 shows a top view of a jet unit in an embodiment of the present invention.

As shown in FIG. 16, in an embodiment, the first buffer retractable arm 503, the second buffer retractable arm 504 and the fairing retractable arm 404 have the same structure, including a second outer sleeve 505. The second outer sleeve 505 is inside provided with a second piston rod 506 penetrating out of the second outer sleeve 505. An end, located in the second outer sleeve 505, of the second piston rod 506 is provided with a second piston 507 matched with the second outer sleeve 505. The parts of the second outer sleeve 505 located on both sides of the second piston 507 are respectively provided with a second hydraulic oil chamber 508 and a second pressure spring 509. The second pressure spring 509 is located close to one end where the second piston rod 506 passes through the second outer sleeve 505. The second hydraulic oil chamber 508 is communicated with an oil storage chamber disposed inside the second outer sleeve 505.

In an embodiment, a three-stage air load-reduction function is added on the basis of the foregoing content, and a specific solution is as follows:

The underwater vehicle 1 is inside provided with a gas storage device 6. A front end of the gas storage device 6 is communicated with a high-pressure collecting chamber 7 disposed in the underwater vehicle 1. The gas storage device in the present invention includes, but is not limited to, a gas storage tank.

A front center of the cavitator 2 (cavitator body 201) is provided with a first jet port 601. The high-pressure collecting chamber 7 is communicated with the first jet port 601 by means of a first vent pipeline system. The first vent pipeline system includes a first vent pipe 602. A rear end of the first vent pipe 602 is communicated with the high-pressure collecting chamber 7. The first vent pipe 602 is provided with a first vent valve 603 inside. A front end of the first vent pipe 602 successively passes through a rear end center of the first outer sleeve 302 and a center of the first piston 304, penetrates into a first piston rod 303, and is in airtight sliding connection with inner walls of the first piston rod 303 and the first piston 304. An inside of the third piston rod 303 close to its front end is provided with a buffer gas chamber. A rear end of the buffer gas chamber is communicated with the front end of the first vent pipe 602, and the buffer gas chamber is inside provided with a first pressure spring 604 with an axis coinciding with an axis of the first piston rod 303. An end face of the first vent pipe 602 abuts against the first pressure spring 604. A front end of the first piston rod 303 is provided with a through hole 605 communicated with the buffer gas chamber, and a front end of the through hole 605 is communicated with the first jet port 601.

An outer wall of the head fairing 401 is provided with a plurality of second jet ports 606. The fairing support rod is provided with a second vent pipe 607 inside. A rear end of the second vent pipe 607 is communicated with the first jet port 601. A rear end of the second jet port 606 is communicated with the second jet port 606 through a hose 608.

A circumferential outer wall of the head end of the underwater vehicle 1 is provided with a plurality of jet units 8, and an axis direction of each the jet unit 8 is perpendicular to the circumferential outer wall of the head end of the underwater vehicle 1. A side wall of each the jet unit 8 is provided with a plurality of third jet ports 801 arranged around the axis of the jet unit 8. One end, away from the circumferential outer wall of the head of the underwater vehicle 1, of each the jet unit 8 is also provided with a third jet port 801, and the plurality of third jet ports 801 are not communicated with each other. The high-pressure gas collecting chamber 7 is communicated with a central gas passage of the jet unit 8 through the third vent pipe 802. The third jet port 801 is communicated with the central gas passage through the second vent valve 803 and a branch gas passage. In an embodiment, five third jet ports 801 are used, four of which are evenly distributed around the axial direction of the jet unit 8, and the other one is arranged at one end, away from the interior of the underwater vehicle 1, of the jet unit 8.

The jet unit 8 is connected to the circumferential outer wall of the head of the underwater vehicle 1 in a retractable manner. The jet unit 8 can be extended or retracted from the underwater vehicle 1. The device driving the jet unit 8 to retract can be an air cylinder, hydraulic cylinder, or other devices.

In addition to the third jet port 801 that achieves the function of jetting forward to reduce load, there are also other third jet port 801 arranged in other directions to adjust the posture of the underwater vehicle 1.

Figure 19:
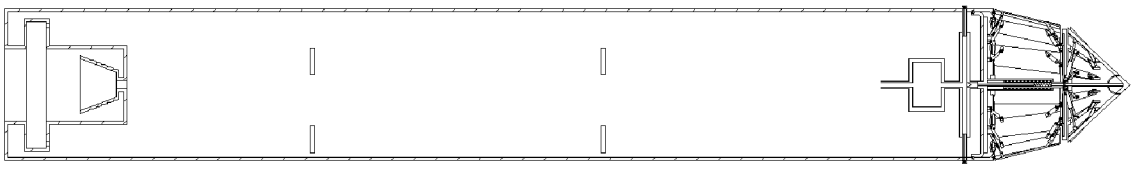
FIG. 19 shows a schematic diagram of an underwater vehicle sailing in the air in an embodiment of the present disclosure.

In use state:

As shown in FIGS. 1 and 19, after the aerial vehicle launches an underwater vehicle 1, the underwater vehicle 1 firstly flies in the air. In order to reduce the air resistance, the cavitator disc face retractable sheets 202 radially contract inwards by adjusting the first buffer retractable arms 503, the second buffer retractable arms 504 and the airfoil adjusting sheets 502, while the side, close to the head fairing, of each the airfoil adjusting sheets 402 is contracts inwards, so that the side fairing device 5 and the head fairing device 4 integrally present a better streamlined shape, thereby reducing the flight wind resistance.

Figure 2:
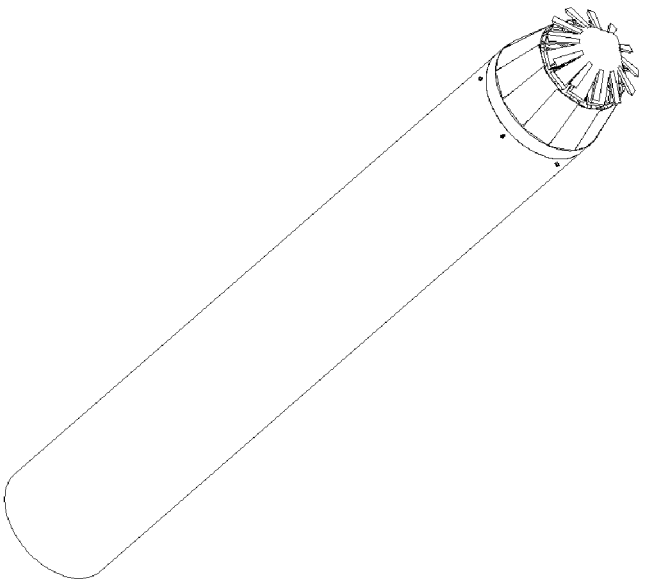
FIG. 2 shows a three-dimensional view of a cavitation load-reduction device for an underwater vehicle having an adjustable water-entry angle in an embodiment of the present invention (the fairing tiles are unfolded).
Figure 3:
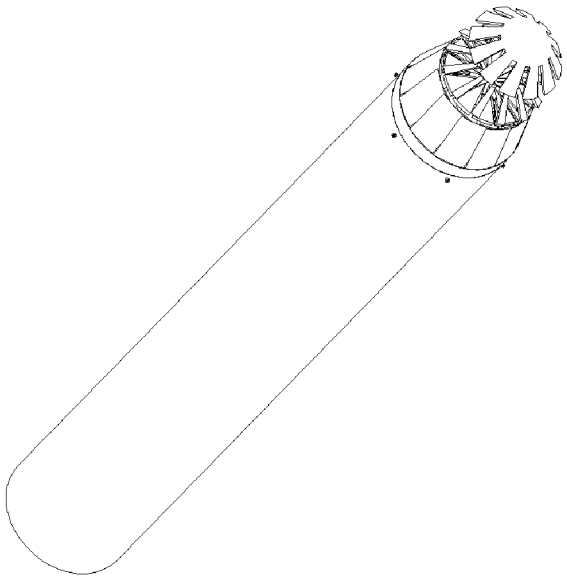
FIG. 3 shows a three-dimensional view of a cavitation load-reduction device when the head fairing is separated in an embodiment of the present invention.
Figure 20:
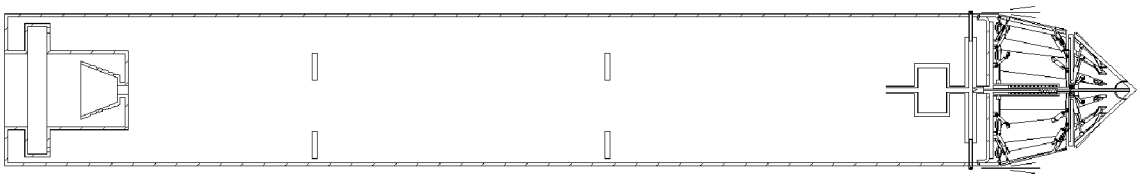
FIG. 20 shows a schematic diagram of jet units of an underwater vehicle when it is jetting in an embodiment of the present invention.

As shown in FIGS. 2 and 20, during the flight process, in order to obtain a better flight posture and water-entry angle, the plurality of jet units 8 originally contracted on the side of the underwater vehicle 1 extend, and a controller inside the underwater vehicle 1 implements a combined jet in an appropriate direction according to the current flight posture, achieving large-scale adjustment and control of the flight posture of the underwater vehicle 1. Meanwhile, through the control of the fairing tile retractable arm 404 (and the active rotating mechanism) in each the head fairing 401, extension and contraction control of each the fairing tile 402 is achieved to assist in adjusting the posture and water-entry angle of the underwater vehicle 1. Since the extended fairing tiles 402 increases the air resistance, in addition to adjusting the posture of the underwater vehicle, the fairing tiles 402 can slow down the underwater vehicle 1 before entering the water to reduce the water-entry load (slamming load is proportional to water-entry speed).

Figure 21:
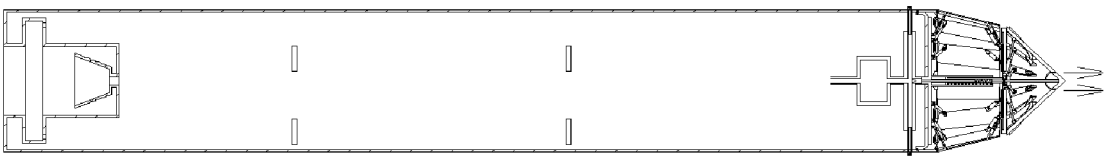
FIG. 21 shows a schematic diagram of jet load-reduction of the second jet port in an embodiment of the present invention.

As shown in FIG. 21, when the underwater vehicle 1 is close to the water surface, the first vent valve 603 is opened and the high-pressure gas is ejected from the second jet port 606 of the head fairing 401, jetting forward to perform reverse jet deceleration and load-reduction before the underwater vehicle 1 enters water.

Figure 4:
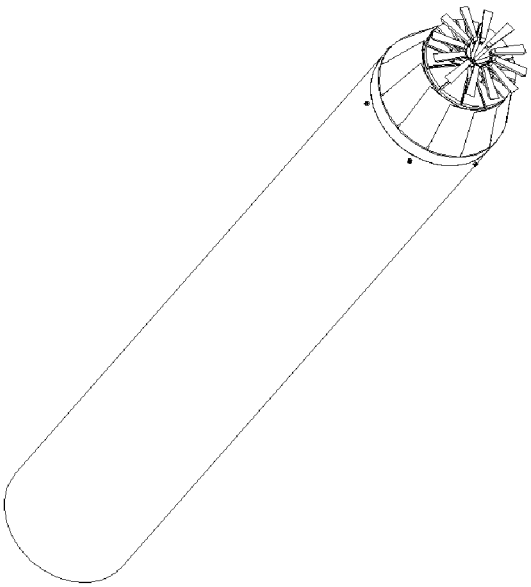
FIG. 4 shows a three-dimensional view of a cavitation load-reduction device after the head fairing is separated in an embodiment of the present invention (the cavitator disc face retractable sheets are not unfolded and the fairing tiles are not reset).
Figure 22:
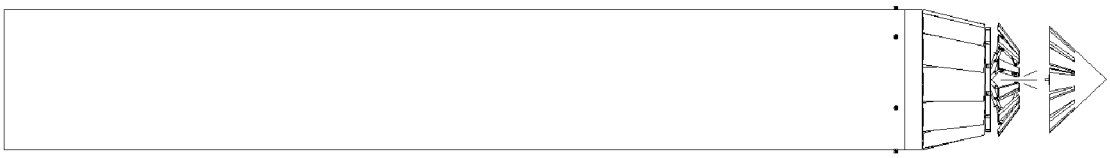
FIG. 22 shows a schematic diagram of jet load-reduction of the first jet port after the head fairing is separated in an embodiment of the present invention.

As shown in FIGS. 4 and 22, the electromagnet at each the hinge joint of the fairing tile 402 and the head fairing 401 is powered off, so that the head fairing 401 is disconnected from the fairing tile 402, thus the fairing tile 402 is separated from the head fairing 401. At the same time, the electromagnet connecting the fairing support rod 403 and the first jet port 601 of the cavitator body 201 is powered off. When the high-pressure gas continues to blow against the fairing support rod 403, the head fairing 401 and the fairing support rod 403 are blown out by the gas and separated from the cavitator body 201 due to the absence of a fixing device. After the head fairing 401 and the fairing support rod 403 are separated and impact the water, an internal airbag inflator is triggered, causing the whole to float and be recycled for reuse.

Figure 23:
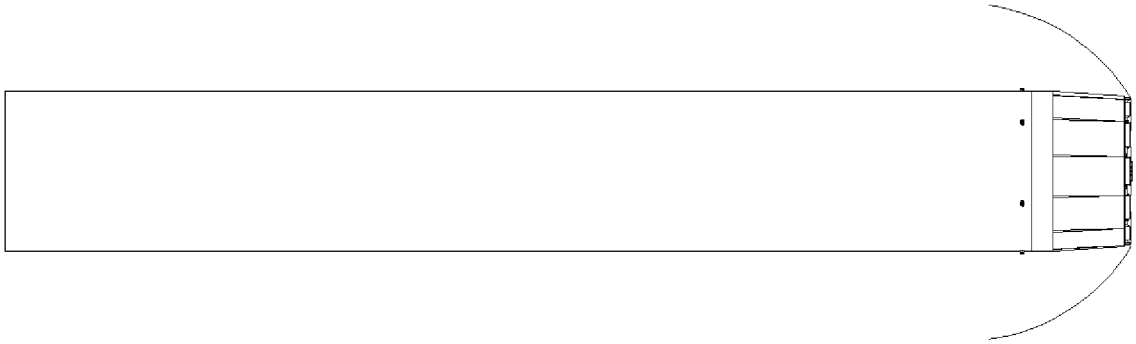
FIG. 23 shows a schematic diagram of an underwater vehicle driving with a supercavity in an embodiment of the present invention.

As shown in FIGS. 5, 6 and 23, after separation, the high-pressure gas continues to blow against the water surface from the first jet port 603 to perform jet load-reduction on the underwater vehicle 1. During this process, the first buffer retractable arms 503 and the second buffer retractable arms 504 drive the cavitator disc face retractable sheets 202 to radially extend outwards, enlarging the radial size of the cavitator 2, and meanwhile, the front end of each the airfoil adjusting sheet 502 also expands. The fairing tiles 402 and the fairing tile retractable arms 404 retract (under the action of the active rotating device or air resistance) to fill the fairing tiles 402 into the clearances between adjacent cavitator disc face retractable sheets 202, thus the fairing tiles 402, the cavitator disc face retractable sheets 202 and the cavitator body 201 are combined to form a cavitator with a larger size, which generates a larger-size supercavity after the underwater vehicle 1 impacts water, ensuring a low navigation resistance.

At last, it should be noted that the above various embodiments are merely intended to illustrate the technical solution of the present invention and not to limit the same; although the present invention has been described in detail with reference to the foregoing embodiments, it should be understood by those ordinary skilled in the art that the technical solutions described in the foregoing embodiments can be modified or equivalents can be substituted for some or all of the technical features thereof; and the modification or substitution does not make the essence of the corresponding technical solution deviate from the scope of the technical solution of each embodiment of the present invention.

The invention claimed is:

1. A cavitation load-reduction device for an underwater vehicle, comprising a cavitator configured to be disposed at a head end of the underwater vehicle, and a head fairing device coaxially disposed with the cavitator at a front end therefore, wherein;

the head fairing device comprises a head fairing and a plurality of fairing tiles, a rear end of a side wall of the head fairing is provided with a plurality of notches around an axis of the head fairing, each of the plurality of notches is configured to receive one of the plurality of fairing tiles; and a center of an inner surface of a front end of the head fairing is fixedly connected with a front end of a fairing support rod, a rear end of the fairing support rod is detachably connected with a center of the cavitator, each fairing tile is connected with a middle part of the cavitator by means of a fairing tile retractable arm in hinged connections with the fairing tile and the cavitator, respectively, and the fairing tile retractable arm is configured to drive the fairing tile to rotate about a hinge point between the fairing tile and the head fairing so that the fairing tile is configured to extend out from and contract into one of the plurality of notches corresponding thereto.

2. The cavitation load-reduction device according to claim 1, further comprising a side fairing device disposed about a circumference of the cavitator, wherein the cavitator comprises a cavitator body and a plurality of cavitator disc face retractable sheets, and the plurality of cavitator disc face retractable sheets are evenly distributed around an axis of the cavitator body; and wherein the side fairing device comprises a side fairing and a linkage adjusting device for driving the cavitator disc face retractable sheets to contract and extend in a radial direction of the cavitator body.

3. The cavitation load-reduction device according to claim 2, wherein;

when the plurality of cavitator disc face retractable sheets are extended, there is a clearance between each two adjacent cavitator disc face retractable sheets, and the clearance aligned with one of the plurality of fairing tiles; and the plurality of fairing tiles, when extended, fill the clearances to form a surface of the cavitator.

4. The cavitation load-reduction device according to claim 2, wherein the side fairing is configured to be affixed to an outer edge of the head end of the underwater vehicle; and wherein the linkage adjusting device comprises a plurality of airfoil adjusting sheets, a number of the airfoil adjusting sheets is matched with a number of the cavitator disc face retractable sheets, the airfoil adjusting sheets are uniformly distributed around the axis of the cavitator body, each airfoil adjusting sheet corresponds to one cavitator disc face retractable sheet, a rear end of each airfoil adjusting sheet is hinged with an outer edge of a front end of the side fairing, a side of each airfoil adjusting sheet close to its rear end is hinged with one end of a first buffer retractable arm and a side of that close to its front end is hinged with one end of a second buffer retractable arm, the other end of the first buffer retractable arm is hinged with a front end face of the head end of the underwater vehicle, the other end of the second buffer retractable arm is hinged with an upper part of the cavitator disc face retractable sheet, a cross section of each airfoil adjusting sheet is airfoil shape, and two adjacent airfoil adjusting sheets are closely attached.

5. The cavitation load-reduction device according to claim 1, wherein a front center of the cavitator is provided with a first jet port, and the first jet port is configured to be connected to a gas storage device disposed in the underwater vehicle by means of a first vent pipeline system.

6. The cavitation load-reduction device according to claim 5, wherein an outer wall of the head fairing is provided with a plurality of second jet ports configured to be connected to the gas storage device by means of a second vent pipeline system.

7. An underwater vehicle, comprising a gas storage device and the cavitation load-reduction device according to claim 1 disposed at the head end of the underwater vehicle, wherein a circumferential outer wall of the head end of the underwater vehicle is provided with a plurality of jet units, an axis direction of each jet unit is perpendicular to the circumferential outer wall of the head end of the underwater vehicle, a side wall of each the jet unit is provided with a plurality of third jet ports arranged around the axis of the jet unit, one end disposed away from the circumferential outer wall of the head of the underwater vehicle of each jet unit is provided with a third jet port, the plurality of third jet ports are communicated with the gas storage device by means of the third vent pipeline system.

8. The underwater vehicle according to claim 7, wherein the cavitator is connected with the head of the underwater vehicle by means of a damper, wherein the damper comprises a first outer sleeve which is provided with a first piston rod inside, a front end of the first piston rod penetrates out of the first outer sleeve and is fixedly connected to the cavitator body, a rear end of the first piston rod is provided with a first piston, a part between the first piston and the front end of the first outer sleeve is provided with a tension spring sleeved on the first piston rod, a rear end of the first outer sleeve is fixedly connected with the head end of the underwater vehicle, and a part between the rear end of the first outer sleeve and the first piston forms a first hydraulic oil chamber which is communicated with an oil storage chamber arranged in the first outer sleeve.

9. The underwater vehicle according to claim 7, further comprising a first vent pipeline system that connects the gas storage device with a first jet port disposed at a front end of the caviator, wherein the first vent pipeline system comprises a first vent pipe, a rear end of the first vent pipe is communicated with the gas storage device, the first vent pipe is provided with a first vent valve, a front end of the first vent pipe successively passes through a rear end center of the first outer sleeve and a center of the first piston, penetrates into the first piston rod, and is in airtight sliding connection with inner walls of the first piston rod and the first piston, an inside of a third piston rod close to its front end is provided with a buffer gas chamber, a rear end of the buffer gas chamber is communicated with the front end of the first vent pipe, the buffer gas chamber is provided inside with a first pressure spring with an axis coinciding with an axis of the first piston rod, an end face of the first vent pipe abuts against the first pressure spring, a front end of the first piston rod is provided with a through hole communicated with the buffer gas chamber, and a front end of the through hole is communicated with the first jet port.

10. The underwater vehicle according to claim 9, further comprising a second vent pipeline system that connects the gas storage device with a plurality of second jet ports disposed at an outer wall of the head fairing, wherein the second vent pipeline system comprises a second vent pipe disposed in the fairing support rod, a rear end of the second vent pipe is communicated with the first jet port, and a rear end of the second jet port is communicated with the second jet port through a hose.

* * * * *